US008096787B2

(12) United States Patent
Green

(10) Patent No.: US 8,096,787 B2
(45) Date of Patent: Jan. 17, 2012

(54) STRAIGHT-LINE PISTON FLUID ENGINE WITH WOBBLE DRIVE VALVE ACTUATION

(76) Inventor: Robert R. Green, Laguna Woods, CA (US)

( * ) Notice: Subject to any disclaimer, the term of this patent is extended or adjusted under 35 U.S.C. 154(b) by 749 days.

(21) Appl. No.: 12/231,907

(22) Filed: Sep. 8, 2008

(65) Prior Publication Data

US 2010/0058923 A1 Mar. 11, 2010

(51) Int. Cl.
*F01B 3/10* (2006.01)
*F01B 3/02* (2006.01)
*F16H 23/08* (2006.01)

(52) U.S. Cl. ..... 417/461; 417/269; 91/475; 91/499; 92/57

(58) Field of Classification Search ..... 91/480, 91/475, 499, 504; 417/269, 461, 460; 92/57, 92/173

See application file for complete search history.

(56) References Cited

U.S. PATENT DOCUMENTS 4,106,354 A * 8/1978 Girodin ..... 74/60
4,122,757 A * 10/1978 McConnell et al. ..... 91/506
4,491,057 A * 1/1985 Ziegler ..... 91/503
6,647,813 B2 * 11/2003 Green ..... 74/45

* cited by examiner

*Primary Examiner* — Devon C Kramer
*Assistant Examiner* — Ryan Gatzemeyer

(57) ABSTRACT

An axial piston fluid engine having single-acting cylinders incorporating swivel-joint attachment of the cylinders to rotary control valves wherein straight-line piston movement is established for the elimination of side forces on the pistons. The pistons and the control valves are operatively connected to a common wobble drive member and arranged in geometry of lever positions to coactively time the drive fluid into and out of the cylinders intermittently.

5 Claims, 6 Drawing Sheets

STRAIGHT-LINE PISTON FLUID ENGINE WITH WOBBLE DRIVE VALVE ACTUATION

BACKGROUND OF THE INVENTION

This invention relates to an axial piston fluid engine with single-acting cylinders pivotally attached to rotary valves that are actuated by a wobble drive member.

Axial piston steam engines of the type having a plurality of pistons along parallel axes pivotally operated by a wobble plate mechanism are known in the art. An example may be seen in U.S. Pat. No. 4,491,057 (Ziegler, 1985). As in other examples such as U.S. Pat. No. 4,106,354 (Girodin, 1978), the engines are encased in a rigid block and have fixed, stationary cylinders. The pistons have ball-jointed piston rods that push and pull a wobble plate mechanism to convert the piston motion into rotary movement.

The engines in these examples have many precisely machined parts and castings as well as an engine block for encasement. The engines are relatively heavy for the power they can produce. The pistons are subject to side pressures from the angular piston rod alignment. Additional piston extensions and seals are needed to accommodate the ball-jointed rods attached to the pistons. Side forces associated with angular piston rod alignment cause pressure against the sides of the pistons and the connecting rods to the wobble plate. The pressure on the pistons, joints and seals require frequent lubrication in places that are not easily accessible. Worn seals and joints are not easily replaced.

No such engine has been adopted for use on a wide scale. The lack of commercial exploitation of this type of engine is probably due to the relative high cost of manufacture as well as maintenance and lubrication issues. Scaling for large and small engines may also be problematic due to the confined space for valve plumbing and actuation. The space restraints between the cylinders prescribe small port openings with restricted gas flow.

SUMMARY OF THE INVENTION

The object of the present invention is to provide improvements to axial piston engines by providing a modular engine with variable number of cylinders that is easily scalable for large and small applications. It is further object to reduce friction by eliminating side forces to the piston. This is accomplished by providing straight-line movement with fewer parts. Reduced weight of reciprocating mass and minimal lubrication requirements are the results of this new arrangement. The valve arrangement allows room for large port sizes for the free flow of fluids. The economy of structure facilitates uncomplicated and economical manufacturing.

In accordance with the present invention, one to eight axial piston cylinders rotate and swivel freely on hollow ball-swivel joints at the base of each cylinder to allow the cylinder to adjust, swivel and pivot with the movement of piston disks attached to piston rods. The piston rods are attached to pivoting drive points around a central wobble drive member. Intermediate the piston disks and the pivoting drive points, a tubular piston rod-guide is centered in a bracket attached to the cylinders to procure alignment of the piston disks within cylinders. The wobble drive member has a central pivot point established by a flexible rod or a universal joint on the crankshaft axis. The wobble drive member conveys the reciprocated movement of the piston disks to a single crank-pin pivotally connected at an angle to the axis of the crankshaft. The aforementioned ball-swivel joints pivotally connect the base of the cylinders to rotary valves that are provided to port fluid to and from the cylinders. The advantageous position of the valves at the base of the cylinders provides ample room for large valve ports to facilitate fluid exchange. Levers controlled by linkage rods operate the valves. The linkage rods are actuated from a connection point on the wobble drive member at substantially 90 degrees from the piston rod drive points of its associated cylinder. The arrangement of the valve linkage connection points on the wobble drive member, provides precise intermittent timing of the intake and exhaust phase of the valves to hold full intake and exhaust positions for the substantial length of the piston strokes.

The axial reciprocating movements of the piston disks are converted into uniform rotation of the crankshaft with greater economy of parts and less reciprocated mass. By means of the forgoing arrangement, the piston drive point displacement along the arcuate path of the wobble drive member is transformed into a straight-line movement of the piston disks within the cylinders. A single "O" ring seal can thus be employed to seal the piston disk within the cylinder wall. Reduced contact between the piston disks and the cylinder walls result in less friction and minimal lubrication requirements. Advantageously, saturated steam can provide adequate lubrication under normal operation.

Other objects and advantages of this invention will become apparent in the detailed description of the straight-line fluid engine as follows.

BRIEF DESCRIPTION OF DRAWING FIGURES

DETAILED DESCRIPTION OF THE PREFERRED EMBODIMENT

Figure 1:
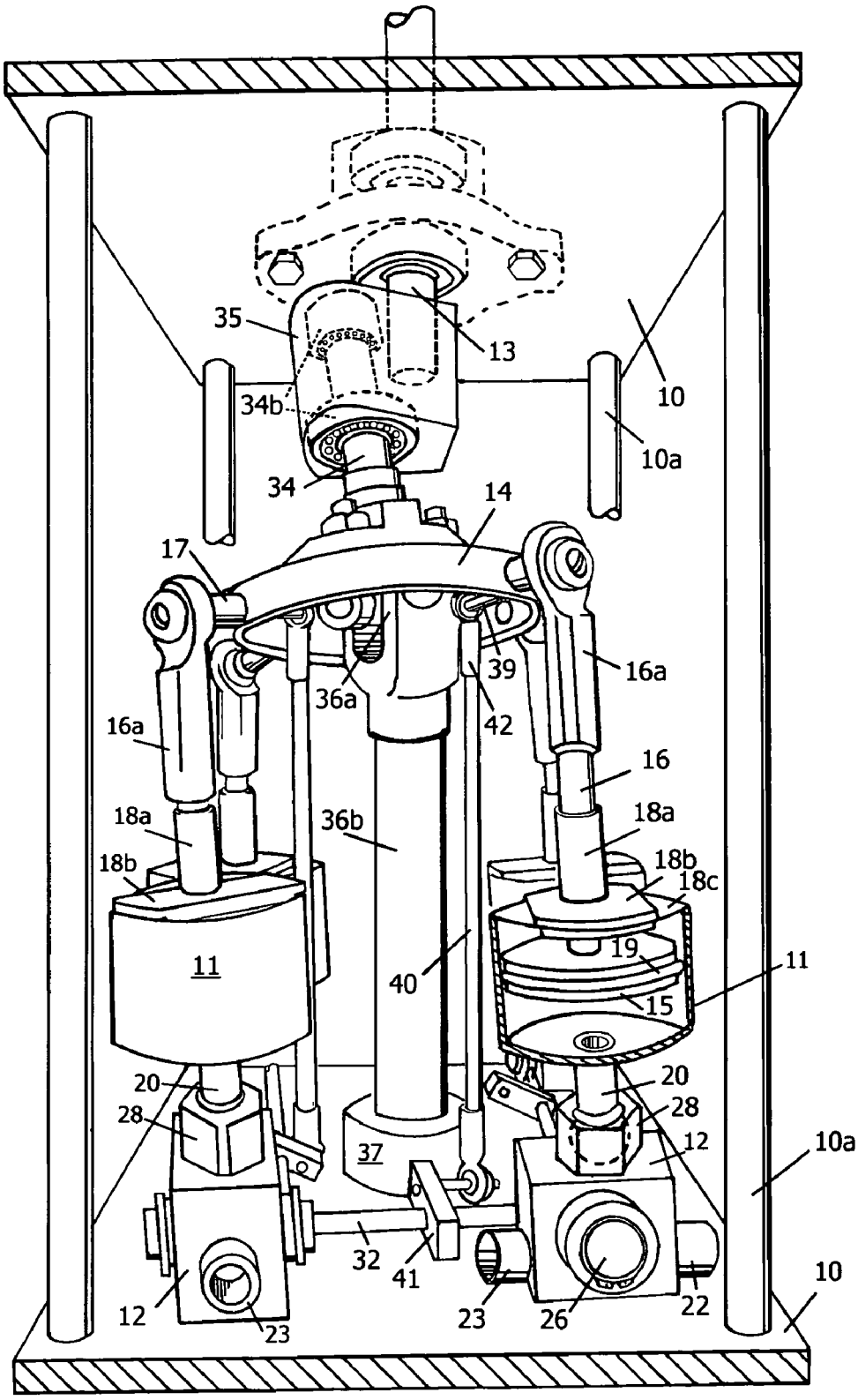
FIG. 1 is a perspective view of a four-cylinder axial piston engine in accordance with one embodiment of the present invention.

Referring to the drawings in detail, FIG. 1 illustrated as the preferred embodiment an axial-piston engine having a frame assembly with four legs 10*a* connecting two end walls generally referred to by numeral 10 supporting in proper operational relationship four basic components consisting of four identical, articulating cylinder assemblies 11, pivotally attached to fixed steam induction valve assemblies 12, an output crankshaft 13, a wobble drive member 14 operatively interconnecting the cylinder assemblies with the crankshaft.

Figure 2:
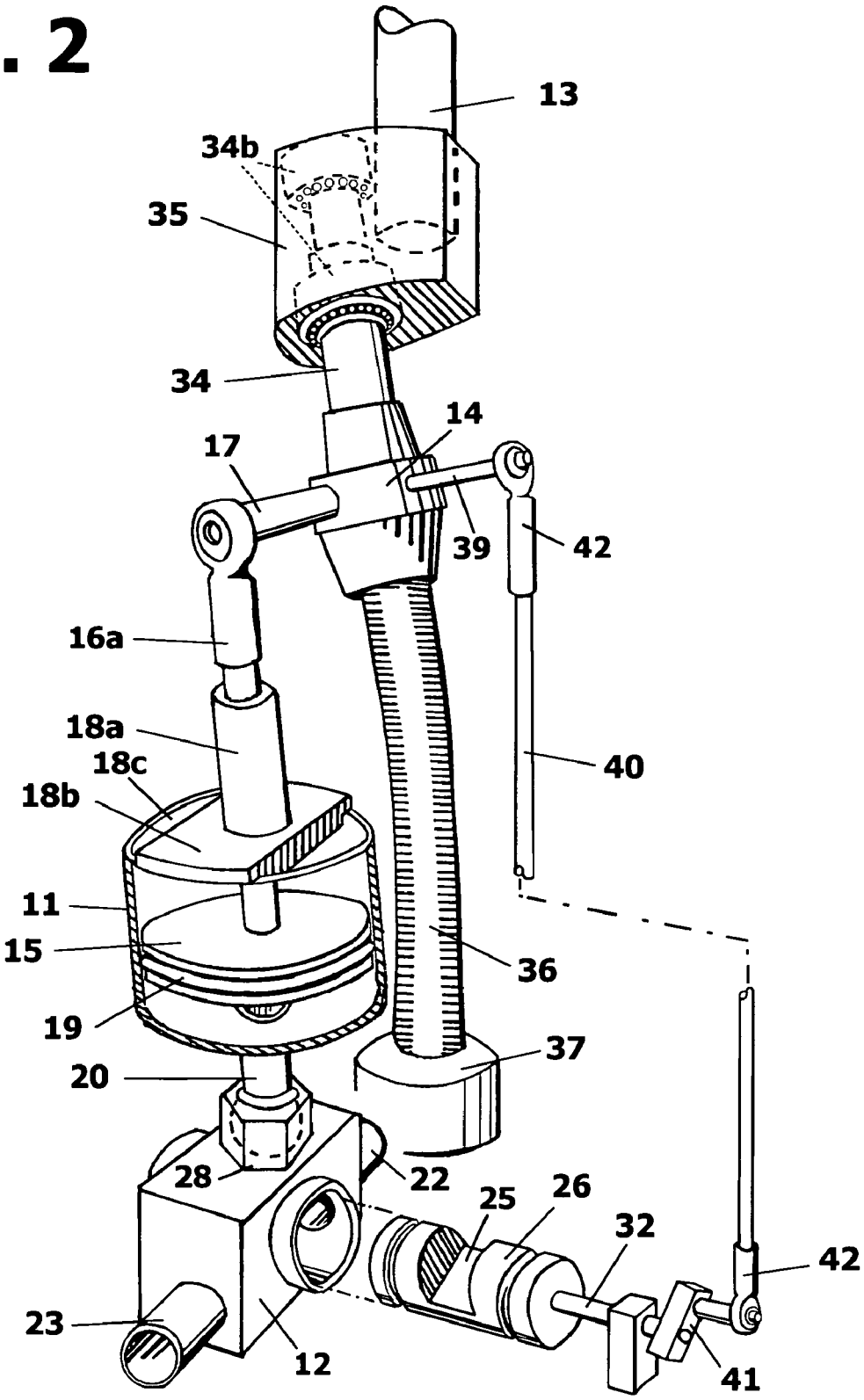
FIG. 2 is a perspective view of a partially exploded single module of an axial piston engine incorporating the essential elements of the embodiment of the present invention.

Cylinder assemblies 11 as shown in FIG. 1 and FIG. 2 consisting of a cylinder pivotally connected to valve assembly 12 by a ball swivel-socket joint 20. Tube 20 is fastened to the bottom of the cylinder and contains a hollow ball made of a durable metal or ceramic material and fits pivotally into an equally durable swivel-socket joint 28 that is replaceably joined to valve 12. A piston-disk 15 within the cylinder is displaceably connected by a connecting rod 16, and aligned to the cylinder by a piston rod guide assembly 18 having a guide tube 18*a* and a tube bracket 18*b* having square sides functioning as cylinder air vents 18c. Piston-disk 15 is provided with a piston ring seal 19 preferable consisting of a well-known "O" ring seal. The opposite end of connecting rod 16 is adjustably secured by a threaded connection to a rod-end 16*a* thus completing the cylinder assembly.

FIG. 2 shows a partially exploded view of a single module of the preferred embodiment of the present invention. The single axial cylinder assembly 11 operationally connected to a piston arm 17 on wobble drive member 14 rotates an axial crank pin 34 with fixed, single axis journals 34*b* about the axis of a single throw crank 35. The journals 34*b* are disposed from each other at a distance to provide stable support of the crank-pin. Wobble drive member 14 is centrally pivoted on a flexible rod 36 that is anchored and rigidly fixed to the wobble pivot member 14 and supported by a frame anchor 37 so that the pivot point lies on the main crankshaft axis. Another embodiment of the central pivot device is described in FIG. 1 wherein a well-known universal joint 36*a* is employed and can be seen anchored to frame wall 10 by a support column 36*b* and to wobble drive member 14. Wobble drive member 14 additionally provides an elongate valve lever 39 substantially disposed at right angle on the radius of the circular plane on wobble drive member 14 relative to the elongate piston arm 17 for actuation of a valve push-rod 40. The geometry involved in such a linkage drive connection between piston lever 17 and valve lever 39 establishes intermittent valve timing wherein fluid is communicated to and from the cylinder for substantially the full intake stroke and the full exhaust stroke of the piston. Piston movement is temporarily suspended during the opening and closing phase of the valve in accordance with the geometry of the present embodiment. Valve push-rod ends 42 pivotally align push rods with valve shaft lever 41. A valve shaft 32 conveys rotation of lever 41 to valve stem 26.

Figure 3:
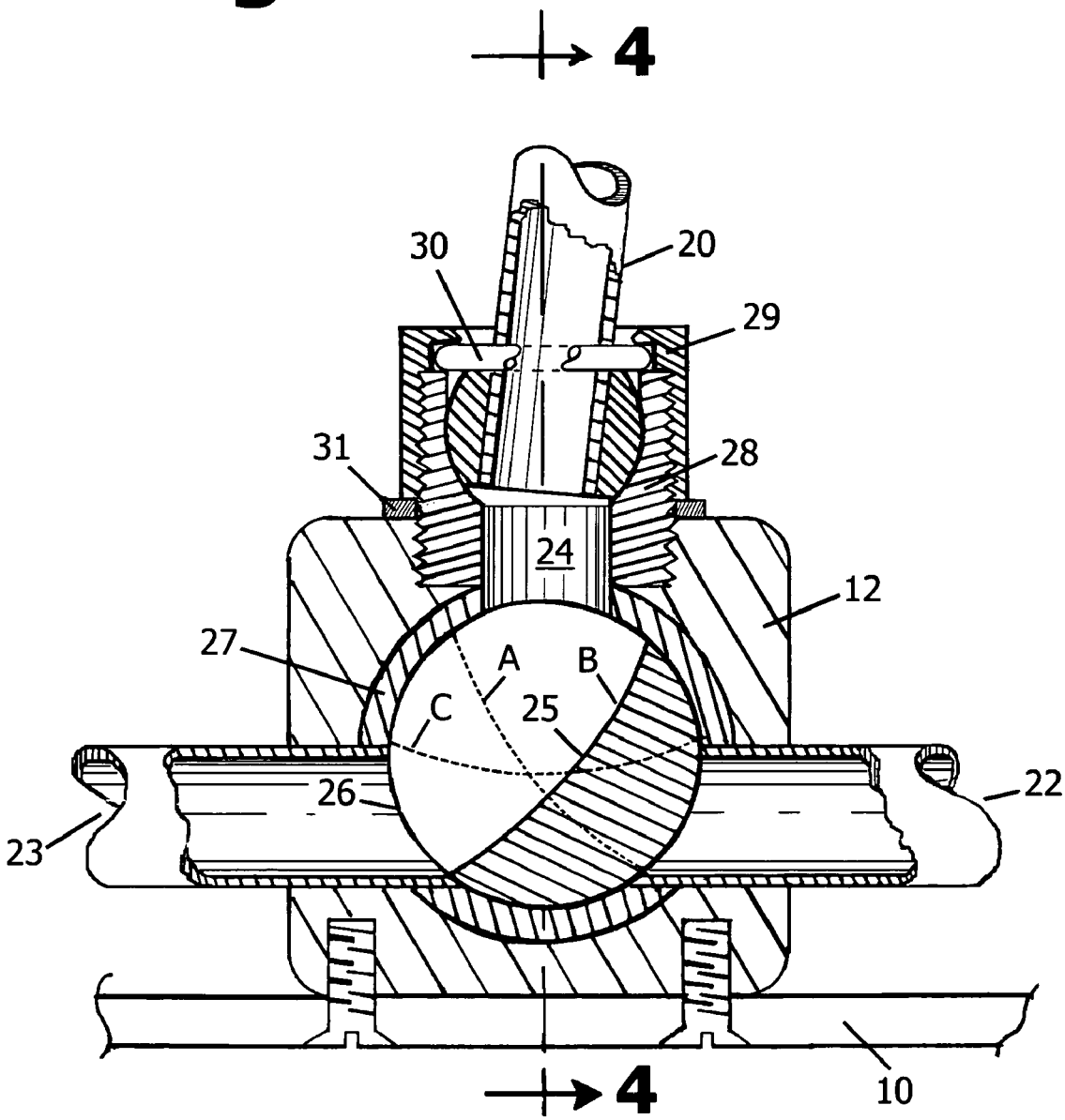
FIG. 3 is a traverse section view of the preferred embodiment of the rotary valve and ball swivel joint of the machine as taken through a plane indicated by section line III-III in FIG. 4. Three positions of the valve stem are illustrated.

Steam induction valve assembly 12 is detailed in FIG. 3 of the preferred embodiment and consists of valve body 12, providing three ports for the communication of fluid to and from cylinder assemblies 11. Interchangeable, intake port 22 and exhaust port 23 direct fluids into and out of a cylinder port 24 through swivel tube 20. Fluid is selectively directed in and out of the cylinders by stem cutout 25 in valve stem 26. Rotational direction of the engine may be determined by the inversion of the intake and exhaust ports. Three positions of the partially rotated cutout 25 are shown in FIG. 3 as intake A, exhaust B, and closed C. A valve bushing 27 is provided to journal valve stem 26. A swivel-socket joint 28 is adjustably threaded into valve body 12 providing a replaceable socket for swivel tube 20. A cap-nut 29 serves as a retainer for swivel tube 20. An "O" ring 30 further seals against leaks. A shim washer 31 adjustably limits "O"ring 30 compression. Valve shaft 32 rotates valve stem during engine operation.

Figure 4:
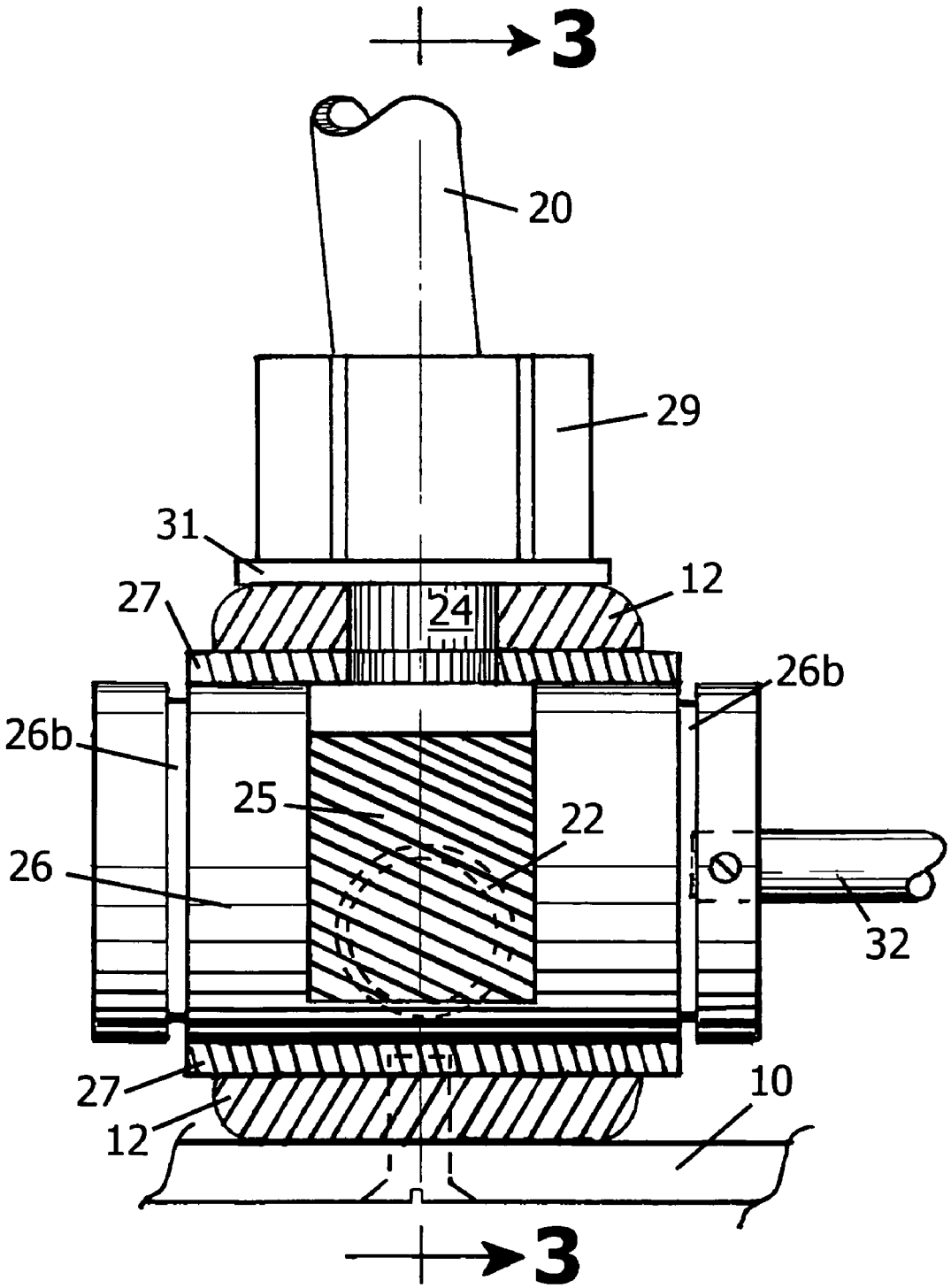
FIG. 4 is a side elevation view taken substantially through a plane indicated by section line IV-IV in FIG. 3. Partial cutaway of the valve bushing and valve body is shown.

Valve body 12 in FIG. 4 shows the side view of valve cutout 26 as in FIG.3 wherein the angular disposed position of the cutout directs fluid into or out of one port while shutting fluid flow to and from the second port. Valve shaft 32 rotates the valve stem. Retainer grooves 26*b* are provided for retainer rings (not shown).

Figure 5:
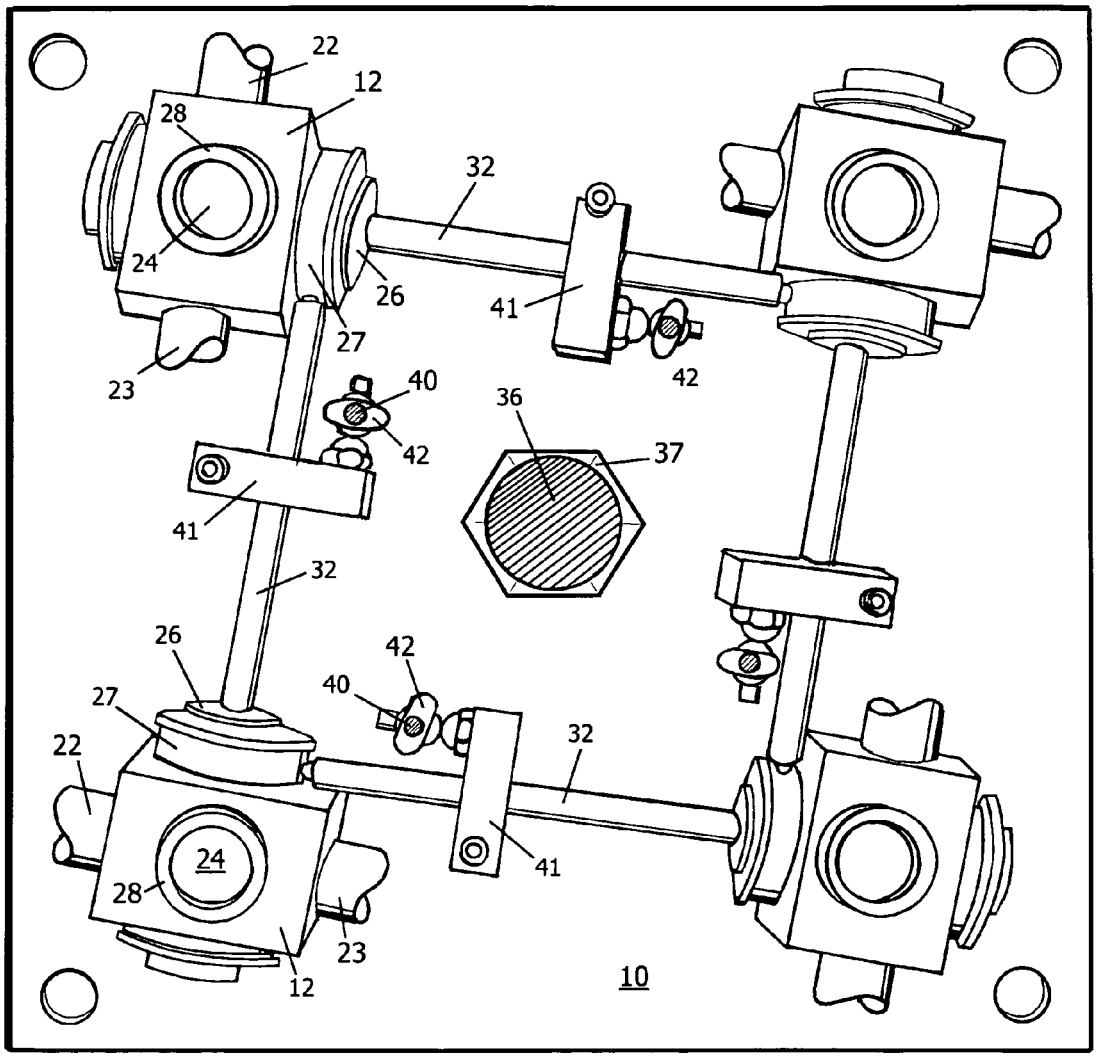
FIG. 5 is a perspective view of a valve arrangement of a four cylinder engine in accordance with one embodiment of the present invention.

FIG. 5 illustrates an embodiment wherein the valve arrangement of a four-cylinder machine is shown as one configuration of a modular machine that can have a selective plurality of cylinders. The configuration of the valve arrangement is variable and is expandable or contractible to accommodate a wide selection of cylinder sizes and length of the piston stroke. Valve-shaft levers 41 are positioned radially in general alignment with push rods 40 to perform an appropriate link with valve shaft levers 39 (FIG. 1, 2, 6). Valves 12 are arranged in operational relation for sequential timing for each cylinder. Levers 41 are reciprocally rotated by push rods 40. Shafts 32 fixed to lever 41 impart partial rotation of the valve stem 26. Bushing 27 serves as a traverse support bearing 21 for shaft 32.

Figure 6:
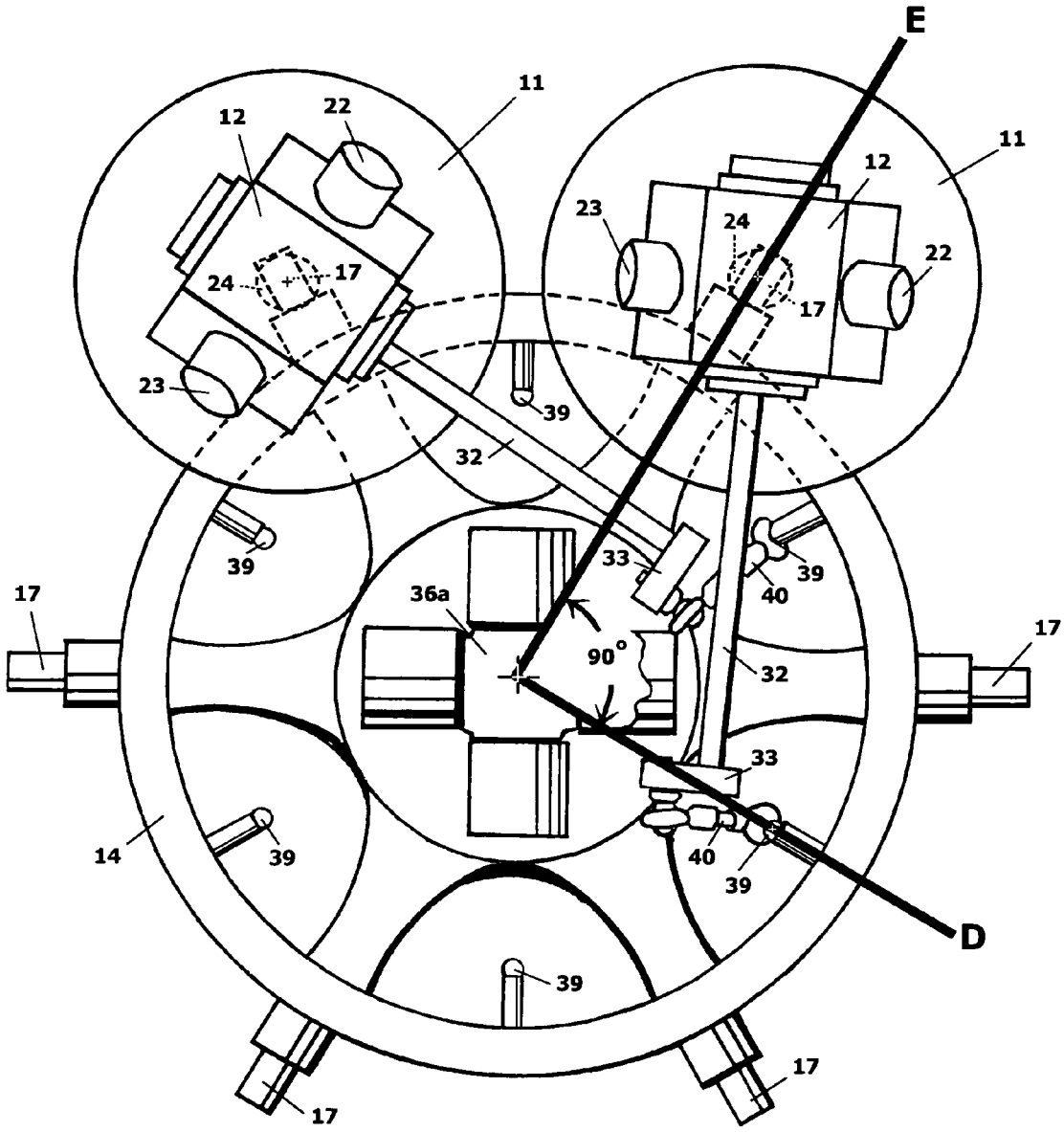
FIG. 6 shows a partial view of a six-cylinder engine of the present invention showing the relative position on the wobble drive member of the piston and the valve drive points.

FIG. 6 shows a partial view of a six-cylinder machine viewed from below. Six piston arms 17 are shown in relation to six valve levers 39. Two cylinder assemblies 11 with their respective attached valves 12 further describing operational arrangement of the present invention provide valve and piston timing in sequential phases. Each valve lever 39 attachment position of the preferred embodiment is placed along one leg of a right angle D. Each cylinder port 24 is established along a second leg of right angle E. The position of the cylinder port 24 and piston arm 17 along leg E determines the length of the piston stroke. Changing the length of the piston stroke has no effect on the valve operation wherein the valve will continue to open coactively for the full length of the stroke for any selected position along leg E. The relative right-angle operational position of the piston arms and valve levers on the wobble drive member 14 as illustrated in FIGS. 1,2,5, and 6 are consistent for any number of cylinders but not limited to actuation of mechanical valves. Actuation of electronic valve-switches is an example of another arrangement of the preferred embodiment.

It should be appreciated that in accordance with the present invention at least one to eight cylinder assemblies are associated with the present invention, one, four and six cylinder examples being described in connection with the illustrated embodiment. While the above description contains many specificities, these should not be construed as limitations of the scope, but rather as an exemplification of one embodiment thereof. Many variations are possible. For example, cylinders may be made of glass, stainless steel, copper, ceramic, carbon fiber, aluminum or any substance suitable to the pressure, temperature and corrosion resistance required for specific operations. Cylinder sizes may be selectively determined and may have different functions. All or a selected number of the cylinders may function as pumps providing a combination of pump and engine. Compressed air, refrigerant or other phase change fluids may be used as a drive fluid. Piston seals may be made of a variety of materials such as rubber, carbon fiber, PTFE or metal depending on the drive fluid and temperature of operation. Crankshaft 13 may be a member of the engine or it may be a member of a separate device such as a generator, refrigerant pump, or water-pump for example. Cylinder assemblies may be quickly exchanged for different power requirements. The wobble drive may incorporate different pivotal devices such as a flexible rod or a common universal joint.

CONCLUSIONS AND RAMIFICATIONS

The combination of components of the fore-described machine of the present invention has produced a modular machine with reduced friction between the cylinders and the pistons due to the straight-line, reciprocal movement of the pistons. The resulting elimination of side forces on the piston preclude heavy piston rods and pistons, and allows the use of "O" ring seals to replace metal rings and tight tolerances. Lubrication requirements are also greatly reduced. In most cases, steam is sufficient lubrication when applied as a steam engine.

Because of low structural complexity, the engine of the present invention may be scaled easily to large or small sizes. The power to weight ratio becomes smaller as the size and number of cylinders increase. The typical engine block has been entirely eliminated in the present embodiment. Heat loss from the cylinders is easily prevented because individual cylinders are isolated from the mass of the engine structure and are easily insulated. Low reciprocal mass associated with the machine further increases efficiency. The improved machine provides lightweight construction, simplicity and versatility resulting in economical production cost compared with other fluid machines.

I claim:

1. An axial piston machine comprising; at least one single acting cylinder and piston assembly, each said assembly having a piston slidable in a cylinder and pivotally connected to a control valve assembly for porting fluid into and from said cylinder;

means establishing precise intermittent valve timing wherein fluid is communicated to and from the cylinder during full piston intake and exhaust strokes; means establishing straight-line movement of said piston within said cylinder; and means establishing rotary movement of the cylinder for the reduction of friction and wear in the cylinder.

2. The machine of claim 1 wherein means establishing intermittent valve timing comprises; a wobble drive member having at least one assembly of a piston arm and a valve operating lever; the piston arm and the valve operating lever disposed on the wobble drive member at substantially ninety degrees and in the same plane as the wobble drive member whereby, movement of the wobble drive member and the geometry between the piston arm and the valve operating lever, temporarily suspends piston movement during the opening and closing phases of the control valve.

3. The machine of claim 2 further comprising;

a) a ball swivel socket joint pivotally connecting said cylinder and piston assembly and said control valve assembly, b) a means for adjusting said ball swivel socket joint for swivel and rotational attachment of the cylinder to the control valve assembly, c) a valve body having three ports and, d) a valve stem traversing through said valve body providing phased reciprocal control means for directing fluid through said three ports; said phased reciprocal control means including a valve stem cutout, a valve shaft and a valve shaft lever operationally connected to said valve operating lever on the wobble drive member whereby, intermittent oscillating and rotating movement of the wobble drive member provides intermittent timed porting of fluid into and from the cylinder.

4. A piston machine comprising; at least one single acting cylinder and piston assembly, each said assembly having a piston slidable in a cylinder and pivotally connected to a ball swivel socket joint; means establishing straight-line movement of said piston in said cylinder for the substantial elimination of unequal force of the piston against the sides-walls of the cylinder, and means establishing rotary movement of the cylinder for providing even distribution of wear in the cylinder and said ball swivel socket joint.

5. The machine of claim 4 further comprising, a) a piston connecting rod secured rigidly to the piston and in guided relation to the cylinder, b) a piston guide tube and a guide tube bracket rigidly fixed to the cylinder and, c) a piston connecting rod-end pivotally attached to a piston arm on a wobble drive member and, d) a swivel tube pivotally and rotationally connecting the cylinder to an adjustable ball swivel socket attached to a control valve for porting fluid into and from the cylinder, whereby, articulated, dynamic alignment and rotation is operationally established between the cylinder, the adjustable ball swivel socket and the piston for eliminating unequal forces between the cylinder and the piston, thereby reducing friction and providing even distribution of wear on the cylinder, the adjustable ball swivel socket and the piston.

* * * * *